US006280229B1

(12) United States Patent
Harting et al.

(10) Patent No.: US 6,280,229 B1
(45) Date of Patent: Aug. 28, 2001

(54) PLUG CONNECTOR

(75) Inventors: Dietmar Harting, Espelkamp; Christa Wellmann; Stephan Schreier, both of Rahden; Volker Schoch, Sachsenheim; Gunter Engelmann, Lugau, all of (DE)

(73) Assignee: Harting KGaA (DE)

( * ) Notice: Subject to any disclaimer, the term of this patent is extended or adjusted under 35 U.S.C. 154(b) by 0 days.

(21) Appl. No.: 09/653,811

(22) Filed: Sep. 1, 2000

(30) Foreign Application Priority Data

Sep. 3, 1999 (DE) ..... 299 15 553 U

(51) Int. Cl.[7] ..... H01R 4/24
(52) U.S. Cl. ..... 439/393; 439/320
(58) Field of Search ..... 439/393, 395, 439/398, 365, 362, 361, 359, 372, 320, 312, 323

(56) References Cited

U.S. PATENT DOCUMENTS 4,497,530 * 2/1985 Shannon ..... 439/488
4,969,839 * 11/1990 Nilsson ..... 439/395
5,100,341 * 3/1992 Czyz et al. ..... 439/447
5,305,547 * 4/1994 Weiss ..... 439/395
5,662,492 * 9/1997 Weiss ..... 439/404

* cited by examiner

*Primary Examiner*—Tulsidas Patel
(74) *Attorney, Agent, or Firm*—Cook, Alex, McFarron, Manzo, Cummings & Mehler, Ltd.

(57) ABSTRACT

The invention relates to a plug connector comprising an insulation displacement contact carrier which accommodates insulation displacement contacts, and a plug contact carrier which accommodates plug contacts. The plug connector further comprises a housing which connects the insulation displacement contact carrier with the plug contact carrier. The insulation displacement contact carrier is provided with a thread for a first coupling ring and the plug contact carrier is provided with a connecting section for a complementary plug connector.

16 Claims, 2 Drawing Sheets

PLUG CONNECTOR

TECHNICAL FIELD

The invention relates to a plug connector by which a rapid mounting of electrical connections can be achieved.

BACKGROUND OF THE INVENTION

German patent specification 42 03 455 discloses an electric plug connector in rapid-connection technique, in which insulation displacement contacts are provided in which the conductors to be connected can be pressed in. For this purpose, the corresponding ends of the conductors are guided in a pressure member over a short distance in inclined fashion to an insertion direction of the pressure member. When the pressure member with the conductors arranged therein is forced on the insulation displacement contacts, the conductors are automatically contacted by the corresponding insulation displacement elements without an additional mounting step or an additional mounting tool being necessary.

Furthermore, it is known to provide the conductors of a cable to be connected with plug contacts to obtain an electrical connection. However, the fact that it is very time-consuming and costly to mount the plug contacts on the cable is a drawback here. Special tools are also necessary.

Therefore, it is the object of this invention to develop a plug connector which can be mounted rapidly and can be used as a female plug or a pin plug.

BRIEF SUMMARY OF THE INVENTION

The above object is achieved in a plug connector which comprises an insulation displacement contact carrier which accommodates insulation displacement contacts, and a plug contact carrier which accommodates plug contacts. The plug connector further comprises a housing which connects the insulation displacement contact carrier with the plug contact carrier. The insulation displacement contact carrier is provided with a thread for a first coupling ring and the plug contact carrier is provided with a connecting section for a complementary plug connector. Such a plug connector is particularly suitable for the attachment technique by threads M8 and M12 and can be used in accordance with DIN EN 60947-5-2 as a female plug or pin plug. Because of its compact design the plug connector according to the invention is in particular suitable for conversion of PG threads to metric threads. By using insulation displacement contacts it is possible to achieve a particularly rapid mounting of the cable to be connected on the plug connector and dismounting thereof, respectively. Apart from a pair of pliers and a knife for cutting the cable to the proper length and for removing part of the cable sheathing no special tool is required for this mounting and dismounting, respectively. The plug contacts can be arranged in the insulation displacement contact carrier and plug contact carrier with a high packing density, so that especially small dimensions can be achieved for the plug connector.

DETAILED DESCRIPTION OF THE PREFERRED EMBODIMENTS

Figure 1:
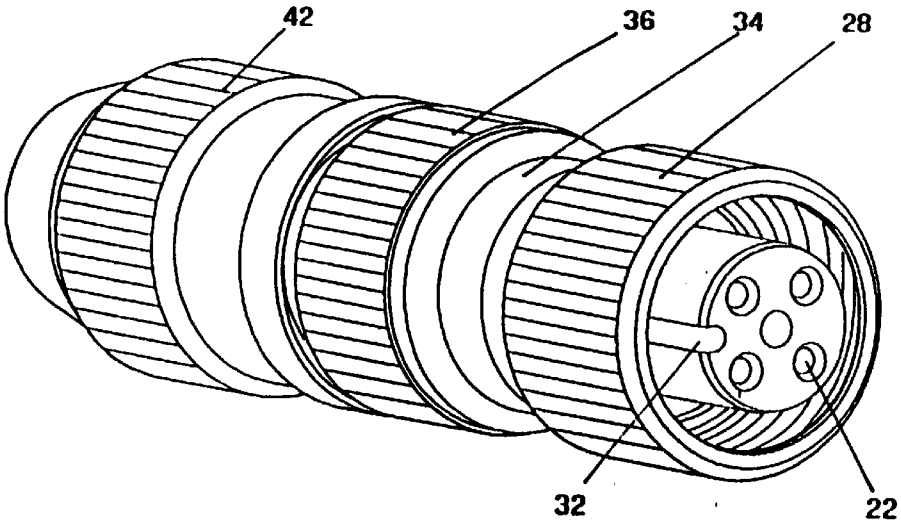
FIG. 1 shows in a perspective view a plug connector having socket contacts.
Figure 2:
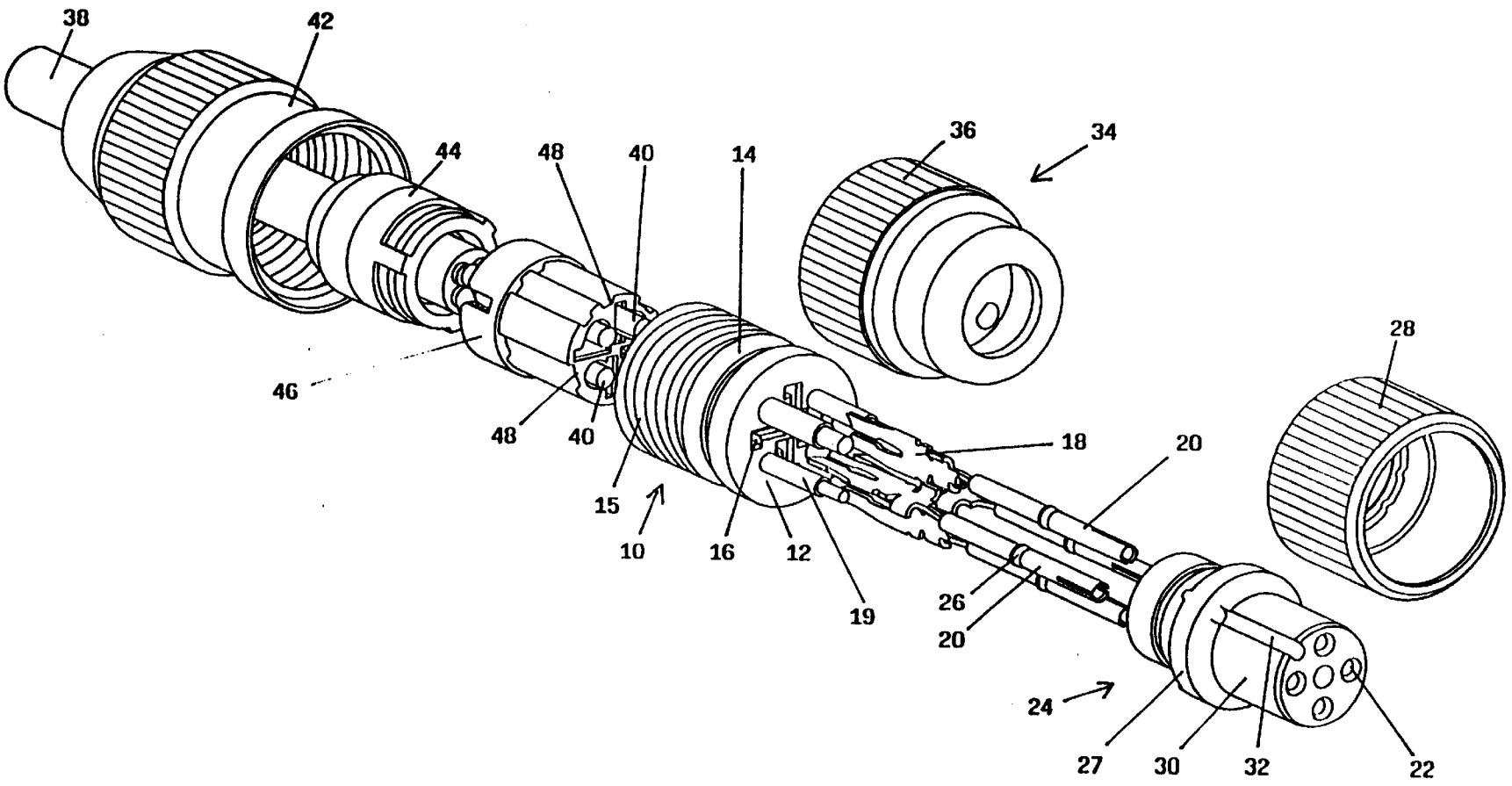
FIG. 2 shows in a perspective exploded view the plug connector of FIG. 1.

FIGS. 1 and 2 show a plug connector according to the invention in which the plug contacts are designed as socket contacts.

The plug connector contains a cylindrical insulation displacement contact carrier 10 which consists of a bottom 12 and a sleeve 14 extending therefrom. Receiving openings 16 for the insulation displacement contacts 18 are provided in the bottom 12. The contacts can be pushed into the receiving openings 16 in axial direction where they snap into place. A thread 15 with which a coupling ring described below can cooperate, is formed on the outer wall of the sleeve 14.

Furthermore, polarization pins 19 are provided on the bottom 12, which cooperate with a plug contact carrier described below.

A plug contact 20 is connected with each insulation displacement contact 18, which is designed as a socket contact here. Each socket contact 20 is received in a receiving opening 22 in a plug contact carrier 24. Each socket contact 20 is provided with a bead 26 by means of which it snaps into place in the receiving opening 22 when it is pushed in there.

The plug contact carrier 24 is provided with an abutment collar 27 for a coupling ring 28, which is in the following specified as second coupling ring 28. The abutment collar 27, the second coupling ring 28 and the plug area 30 of the plug contact carrier 24, which is surrounded by the second coupling ring 28, form a connecting section for a complementary plug connector.

In the outer wall of the plug area 30, a groove 32 is designed which is approximately semi-circular in cross-section and serves for positioning the socket contacts relative to a complementary plug connector.

The plug connector is mounted as follows: First, the second coupling ring 28 is pushed on the plug contact carrier 24 until it abuts against the abutment collar 27. Then, the insulation displacement contacts 18 and the socket contacts 20, which are connected with each other, are pushed into the insulation displacement contact carrier 10 and the plug contact carrier 24 until they snap into place there. Because of the polarization pins 19 the correct positioning and polarization of the plug contact carrier 24 relative to the insulation displacement contact carrier 10 is ensured in this connection.

Thereafter, the prefabricated unit consisting of insulation displacement contact carrier 10, insulation displacement contacts 18, socket contacts 20 and plug contact carrier 24 are surrounded by molding with plastic material, so that a housing 34 is formed which combines the parts into a unit mechanically fixedly connected with one another. The housing 34 has a substantially cylindrical shape and is provided with a knurling 36 on part of its outer surface, so that it can be gripped better in the subsequent mounting of a cable on the plug-and-socket connector.

A cable 38 can be connected to the described plug-and-socket connector such that its wires 40 are connected with the corresponding insulation displacement contacts 18 in an electrically conductive way. For this purpose, there is used a rapid-connection system as known from German patent specification 42 03 455, which is incorporated herein by reference.

For mounting the cable, part of the outer sheathing of the cable is initially removed, so that the individual wires 38 are accessible. Then, a knurled first coupling ring 42 and an insulating insert 44 are pushed on the cable. The individual wires 40 are then pushed into corresponding guide bores of a pressure member 46. In this connection, all wires are guided initially in axial direction, then over a predetermined distance in inclined fashion and finally again in axial direction until they protrude from the front side of the pressure member 46. On its outer side, the pressure member 46 is provided with polarization arrangements 48 which together with complementary polarization arrangements in the interior of the sleeve 14 ensure that the individual wires of the cable are connected with the correct insulation displacement contact.

The cable 38 is connected with the plug connector by inserting the pressure member 48 in the sleeve 14 and fully forcing it into the sleeve by screwing the first coupling ring 42 on the thread 15 of sleeve 14. In this connection, the insulation displacement contacts sever the sheathing of the wires in the inclined areas, so that contacting of the wires is ensured without further mounting steps and without special tools. The forces required for pressing the pressure member 46 into the sleeve 14 can be applied manually in simple manner, since the knurling 36 on the housing 34 and the knurling on the second coupling ring 42 ensure good manageability.

Figure 3:
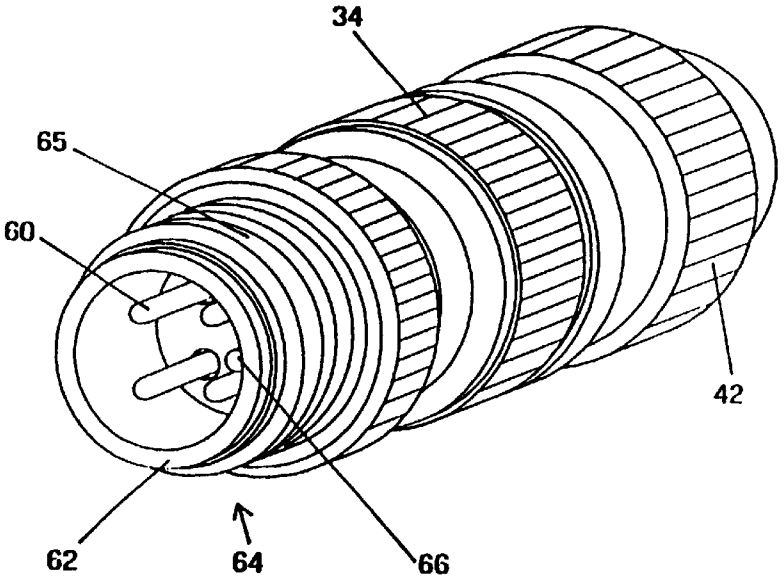
FIG. 3 shows in a perspective view a plug connector having pin contacts.

FIG. 3 shows a plug connector which is complementary to the plug connector shown in FIGS. 1 and 2, i.e. is provided with plug contacts 60 in place of the socket contacts 20. As regards the basic design the plug connector shown in FIG. 3 does not differ from the plug connector shown in FIGS. 1 and 2. The only difference consists in that the connecting section 64 of the plug connector provided with the plug contacts 60 is designed as a sleeve 62 which has an external thread 65. The second coupling ring 28 of the plug connector shown in FIGS. 1 and 2 can be screwed on this outer thread to firmly connect the two plug connectors with each other. On the inner wall of the sleeve 62, a bead 66 is provided which is almost semi-circular in cross-section. Together with the groove 32 this bead serves in the plug contact carrier 24 to ensure the correct polarization between the socket contacts 20 and the plug contacts 60.

What is claimed is:

1. A plug connector comprising:

an insulation displacement contact carrier which accommodates insulation displacement contacts, a plug contact carrier which accommodates plug contacts, and a housing which connects said insulation displacement contact carrier with said plug contact carrier, said insulation displacement contact carrier being provided with a thread for a first coupling ring and said plug contact carrier being provided with a connecting section for a complementary plug connector.

2. The plug connector according to claim 1, wherein said insulation displacement contacts are snapped into place in said insulation displacement contact carrier.

3. The plug connector according to claim 1, wherein said plug contacts are snapped into place in said plug contact carrier.

4. The plug connector according to claim 1, wherein said insulation displacement contact carrier is provided with polarization pins which engage corresponding bores at said plug contact carrier and ensure its correct polarization relative to said insulation displacement contact carrier.

5. The plug connector according to claim 4, wherein means for ensuring a correct polarization are provided in both an area of said connecting section and an area of said plug contacts.

6. The plug connector according to claim 1, wherein said plug contacts are designed as socket contacts and said connecting section of said housing is provided with a second coupling ring.

7. The plug connector according to claim 1, wherein said plug contacts are designed as pin contacts and said connecting section of said housing is provided with a thread for a coupling ring.

8. The plug connector according to claim 1, wherein said housing connects in non-detachable manner said insulation displacement contact carrier with said plug contact carrier.

9. A plug connector for connection to a cable having individual wires comprising:

a first coupling ring;

an insulating insert positioned within said first coupling ring and coaxially disposed relative to the cable;

a pressure member including guide bores for receiving individual wires of the cable;

an insulation displacement contact carrier which accommodates insulation displacement contacts;

a plug contact carrier which accommodates plug contacts; and a housing which connects said insulation displacement contact carrier with said plug contact carrier;

said insulation displacement contact carrier being provided with a thread for engagement with said first coupling ring and said plug contact carrier being provided with a connecting section for a complementary plug connector.

10. The plug connector according to claim 9 wherein said insulation displacement contacts are snapped into place in said insulation displacement contact carrier.

11. The plug connector according to claim 9 wherein said plug contacts are snapped into place in said plug contact carrier.

12. The plug connector according to claim 9 wherein said insulation displacement contact carrier is provided with polarization pins which engage corresponding bores at said plug contact carrier and ensure its correct polarization relative to said insulation displacement contact carrier.

13. The plug connector according to claim 12 wherein means for ensuring a correct polarization are provided in both an area of said connecting section and an area of said plug contacts.

14. The plug connector according to claim 9 wherein said plug contacts are designed as socket contacts and said connecting section of said housing is provided with a second coupling ring.

15. The plug connector according to claim 9 wherein said plug contacts are designed as pin contacts and said connecting section of said housing is provided with a thread for a coupling ring.

16. The plug connector according to claim 9 wherein said housing connects in non-detachable manner said insulation displacement contact carrier with said plug contact carrier.

* * * * *

UNITED STATES PATENT AND TRADEMARK OFFICE

CERTIFICATE OF CORRECTION

PATENT NO. : 6,280,229 B1
DATED : August 28, 2001
INVENTOR(S) : Dietmar Harting et al.

It is certified that error appears in the above-identified patent and that said Letters Patent is hereby corrected as shown below:

Title page,
Item [73] should read:
-- Assignees: Harting KGaA (DE)
Murrelektronik GmbH (DE) --

Signed and Sealed this

Seventeenth Day of September, 2002

*Attest:*

*Attesting Officer*

JAMES E. ROGAN
*Director of the United States Patent and Trademark Office*